US010969209B2

(12) United States Patent
Stock, Jr. et al.

(10) Patent No.: US 10,969,209 B2
(45) Date of Patent: Apr. 6, 2021

(54) SEGMENTING PISTOL BULLET

(71) Applicant: Olin Corporation, St. Louis, MO (US)

(72) Inventors: Michael Eugene Stock, Jr., Edwardsville, IL (US); Kyle Adam Masinelli, Oxford, MS (US); Connor M. McDermot, Abbeville, MS (US)

(73) Assignee: OLIN CORPORATION, St. Louis, MO (US)

( * ) Notice: Subject to any disclaimer, the term of this patent is extended or adjusted under 35 U.S.C. 154(b) by 0 days.

(21) Appl. No.: 15/896,730

(22) Filed: Feb. 14, 2018

(65) Prior Publication Data

US 2019/0249964 A1 Aug. 15, 2019

(51) Int. Cl.

| | |
|---|---|
| ***F42B 12/34*** | (2006.01) |
| ***F42B 12/36*** | (2006.01) |
| ***F42B 12/78*** | (2006.01) |
| ***F42B 12/74*** | (2006.01) |

(52) U.S. Cl.

CPC ..... *F42B 12/367* (2013.01); *F42B 12/34* (2013.01); *F42B 12/74* (2013.01); *F42B 12/78* (2013.01)

(58) Field of Classification Search

CPC ..... F42B 12/34; F42B 12/78; F42B 12/74; F42B 12/36; F42B 12/56; F42B 12/76

USPC ..... 102/507–510, 516–517

See application file for complete search history.

(56) References Cited

U.S. PATENT DOCUMENTS

| | | | | | |
|---|---|---|---|---|---|
| 854,923 | A * | 5/1907 | Broad | F42B 12/34 | 102/508 |
| 1,135,357 | A * | 4/1915 | Clyne | F42B 12/34 | 102/508 |
| 1,322,662 | A * | 11/1919 | Watson | F42B 12/34 | 102/510 |
| 1,493,614 | A * | 5/1924 | Dickerman | F42B 12/34 | 102/510 |
| 3,427,976 | A * | 2/1969 | Lucy | F42B 12/34 | 102/507 |
| 4,044,685 | A * | 8/1977 | Avcin | F42B 12/34 | 102/508 |
| 4,245,557 | A * | 1/1981 | Knappworst | F42B 12/34 | 102/508 |
| 4,655,140 | A * | 4/1987 | Schirneker | F42B 10/22 | 102/508 |
| 4,776,279 | A * | 10/1988 | Pejsa | F42B 12/34 | 102/510 |
| 5,621,186 | A * | 4/1997 | Carter | F42B 12/34 | 102/507 |
| 6,845,717 | B1 * | 1/2005 | Sauvestre | F42B 12/34 | 102/518 |
| 7,380,502 | B2 * | 6/2008 | Emary | F42B 12/34 | 102/506 |

(Continued)

*Primary Examiner* — Jonathan C Weber
(74) *Attorney, Agent, or Firm* — Harness, Dickey & Pierce, P.L.C.

(57) ABSTRACT

A bullet having a generally cup-shaped jacket, a core disposed inside the jacket, and partially divided into a plurality of segments by a plurality of slits formed therein is mounted at the front of the jacket. A tip is mounted in the core. The tip has a plurality of notches formed its forwardly facing ogival surface; each notch having a forward end adjacent the forward end of the tip, and a rear end rearward of the rearwardly facing shoulder and the front end of the jacket, so that material from the target can enter the jacket and help open the jacket and release the core.

19 Claims, 5 Drawing Sheets

(56) References Cited

U.S. PATENT DOCUMENTS 8,161,885 B1 * 4/2012 Emary ..... F42B 12/34 102/506
8,186,277 B1 * 5/2012 King ..... F42B 12/74 102/507
9,003,974 B2 * 4/2015 Muskat ..... F42B 12/02 102/507
9,631,910 B2 * 4/2017 Fricke ..... F42B 12/34
9,702,677 B2 * 7/2017 Balzano ..... F42B 12/34
9,797,696 B2 * 10/2017 Golloher ..... F42B 12/34
9,841,260 B2 12/2017 Lemke et al.
10,041,773 B2 * 8/2018 Peterson ..... F42B 12/74
10,082,377 B1 * 9/2018 Imhoff ..... F42B 12/34
10,101,137 B2 * 10/2018 Burczynski ..... F42B 10/46
2004/0129165 A1 * 7/2004 Cesaroni ..... F42B 12/745 102/516
2010/0224093 A1 * 9/2010 Wilhelm ..... F42B 12/34 102/507
2014/0202351 A1 * 7/2014 Muskat ..... F42B 12/02 102/514
2014/0318406 A1 * 10/2014 Rall ..... F42B 33/001 102/510
2015/0345920 A1 * 12/2015 Emary ..... F42B 12/34 102/507
2015/0354930 A1 * 12/2015 Fricke ..... F42B 12/34 102/439
2016/0153757 A1 * 6/2016 Mahnke ..... F42B 10/22 102/501
2016/0169645 A1 * 6/2016 Emary ..... F42B 12/74 102/439
2017/0108320 A1 * 4/2017 Peterson ..... F42B 12/74
2017/0261294 A1 * 9/2017 Riess ..... F42B 5/025
2017/0322002 A1 * 11/2017 Mahnke ..... F42B 10/22
2018/0094911 A1 * 4/2018 Fournier ..... F42B 14/02
2018/0224249 A1 * 8/2018 Carbone ..... F42B 10/44

* cited by examiner

SEGMENTING PISTOL BULLET

FIELD

This invention relates to bullets, and in particular to a bullet that breaks up into multiple pieces when it impacts a target.

BACKGROUND

This section provides background information related to the present disclosure which is not necessarily prior art.

Bullets are designed for various functions and uses. One desirable function is breaking up upon impacting a target, to form multiple channels in, and maximum disruption of, the target. This function can be particularly difficult to achieve in pistol bullets which are typically fired at lower velocities, and are thus harder to make to reliably break up. Furthermore, projectiles that do reliably break up upon impacting a target typically do not achieve the desired penetration of the projectile fragments for its intended purpose.

SUMMARY

This section provides a general summary of the disclosure, and is not a comprehensive disclosure of its full scope or all of its features.

Embodiments of this invention provide a bullet that reliably breaks up into multiple pieces and penetrates with a multitude of fragments achieving greater than 10" of penetration in 10% ordnance gelatin, even at velocities typically encountered in handgun ammunition. Generally, a preferred embodiment of a bullet constructed according to the principles of this invention comprises a jacket, a core, and a tip. The jacket is generally cup-shaped with a closed rear end, an open front end, and a generally cylindrical sidewall between the rear end and the front end with an inwardly tapering lip adjacent the front end. The core is disposed inside the jacket, and has a plurality of slits formed therein. The tip has a forwardly facing ogival surface tapering to a front end. The tip has a rearwardly facing surface tapering to a shank that is embedded in the core. There is a rearwardly facing shoulder abutting the front-facing face of the front end of the jacket forming a smooth transition therewith. There are a plurality of notches formed in the forwardly facing ogival surface of the tip. Each notch has a front end adjacent the front end of the tip, and a rear end rearward of the rearwardly facing shoulder and the front end of the jacket.

The core is preferably cylindrical, and has an axial passage extending from the rear of the core to the front of the core. The slits in the core preferably extend radially outwardly from the axial passage partway toward the exterior of the core. The slits are equally spaced around the circumference of the core, and there are preferably four slits which facilitate the core breaking up. The core is preferably lead or a lead alloy.

The jacket preferably has a plurality of scores adjacent the front end. The scores are preferably equally spaced circumferentially around the jacket. In the preferred embodiment there are six scores that facilitate the opening of the jacket. The thickness of the jacket preferably tapers from the rear end to the front end. The jacket is preferably copper or a copper alloy.

The notches in the tip are preferably equally spaced around the circumference of the tip, and there are preferably three notches. The tip is preferably made of a polymer filled with a metal powder, such as copper powder or copper alloy.

The bullet of the preferred embodiment is of simple construction. The notches in the tip channel material into the interior of the jacket, facilitating the opening of the scored jacket, and the fragmentation of the core.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
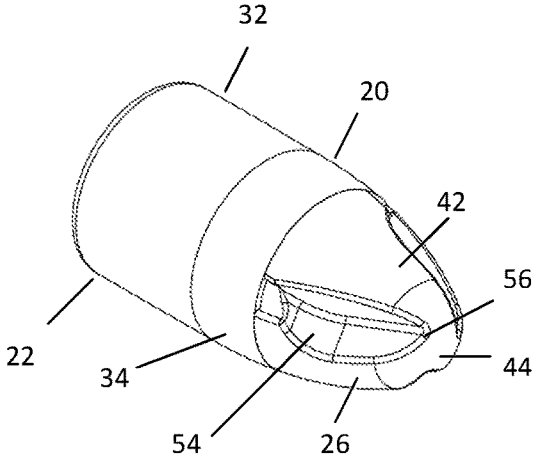
FIG. 1 is a perspective view of a preferred embodiment of a bullet according to the principles of the present invention.
Figure 2:
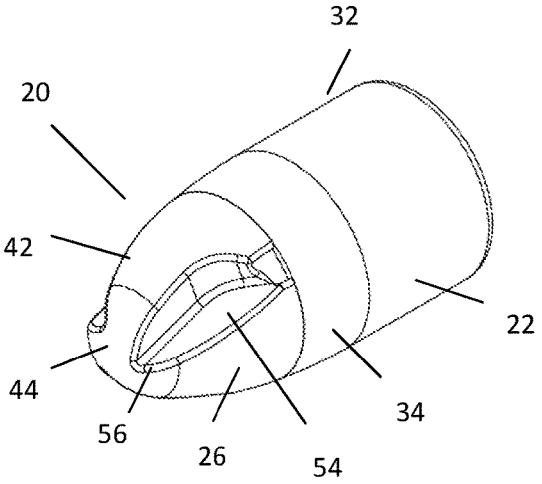
FIG. 2 is a perspective view of the preferred embodiment of a bullet according to the principles of the present invention.
Figure 3:
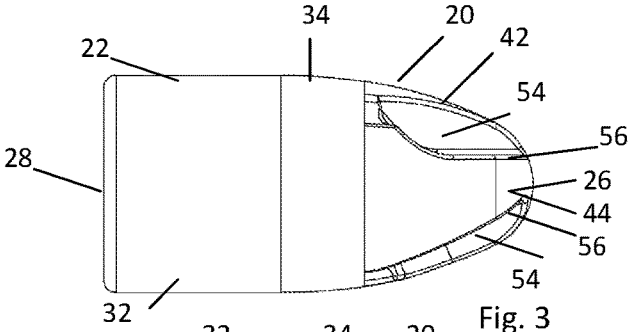
FIG. 3 is a side elevation view of the preferred embodiment of a bullet according to the principles of the present invention.
Figure 6:
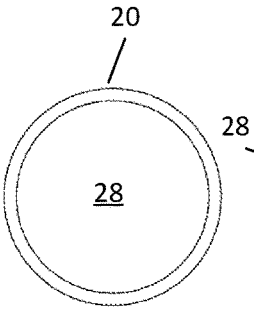
FIG. 6 is a rear end elevation view of the preferred embodiment of a bullet as shown in FIG. 4.
Figure 4:
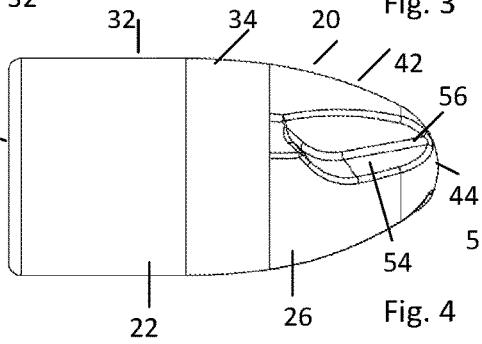
FIG. 4 is a side elevation view of the preferred embodiment of a bullet according to the principles of the present invention, rotated about its longitudinal axis 90° from the view of FIG. 3.
Figure 5:
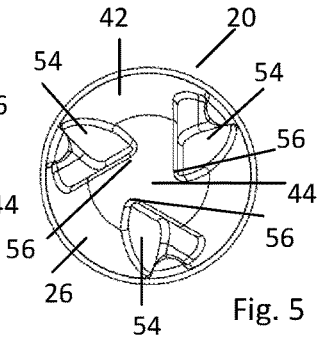
FIG. 5 is a front end elevation view of the preferred embodiment of a bullet as shown in FIG. 4.

Example embodiments will now be described more fully with reference to the accompanying drawings.

A preferred embodiment of a bullet constructed according to the principles of this invention is indicated generally as 20 in the Figures. Bullet 20 preferably comprises a jacket 22, a core 24, and a tip 26.

The jacket 22 is generally cup-shaped with a closed rear end 28, an open front end 30, and a generally cylindrical sidewall 32 between the rear end and the front end, and an inwardly tapering lip 34 adjacent the front end. The jacket 22 preferably has a plurality of scores 36 adjacent the front end 30. The scores 36 are preferably equally spaced around the circumference of the jacket 22. In the preferred embodiment there are six scores 36 that facilitate the opening of the jacket into "petals" releasing the core, as described below. However there could be fewer (e.g. 2 to 5) or more (e.g., 7 to 10) scores, if desired. These scores 36 can be full or partial cuts in the material adjacent the front end 30. The thickness of the sidewall 32 of the jacket 22 preferably tapers from the rear end 28 toward the front end 30. The jacket 22 is preferably made of copper or a copper alloy, but other suitable materials could be used.

Figure 8:
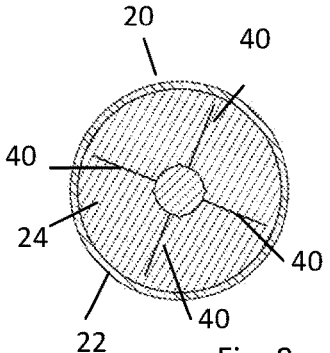
FIG. 8 is a transverse cross-sectional view of the preferred embodiment of a bullet as shown in FIG. 7.
Figure 7:
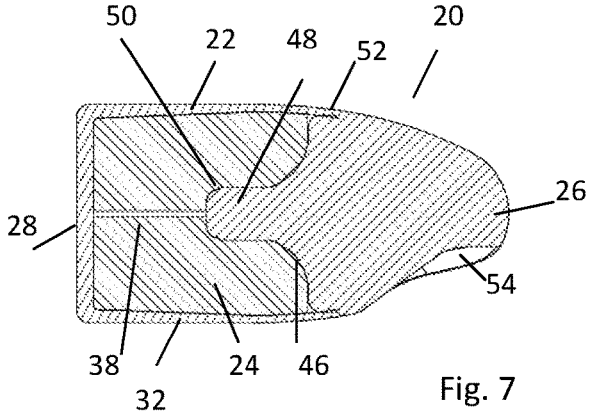
FIG. 7 is a longitudinal cross-sectional view of the preferred embodiment of a bullet as shown in FIG. 4.
Figure 10:
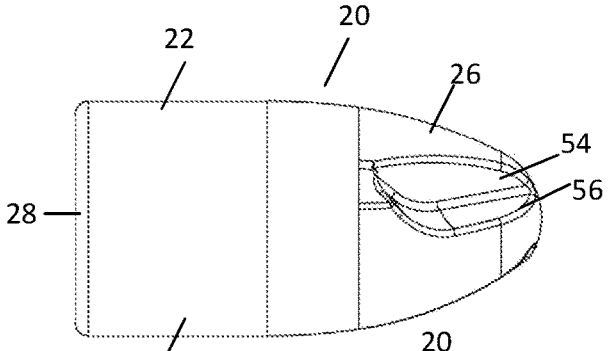
FIG. 10 is a side elevation view of the preferred embodiment of a bullet as shown in FIG. 9.
Figure 11:
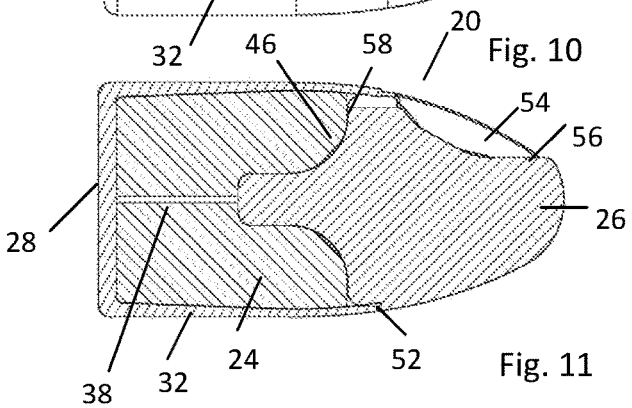
FIG. 11 is a longitudinal cross-sectional view of the preferred embodiment of a bullet as shown in FIG. 9.
Figure 9:
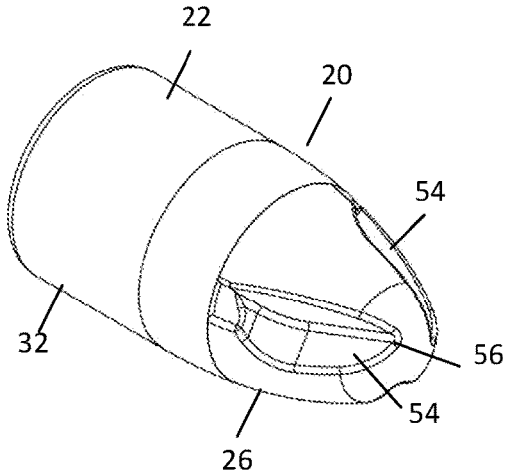
FIG. 9 is a perspective view of the preferred embodiment of a bullet according to the principles of the present invention.
Figure 12:
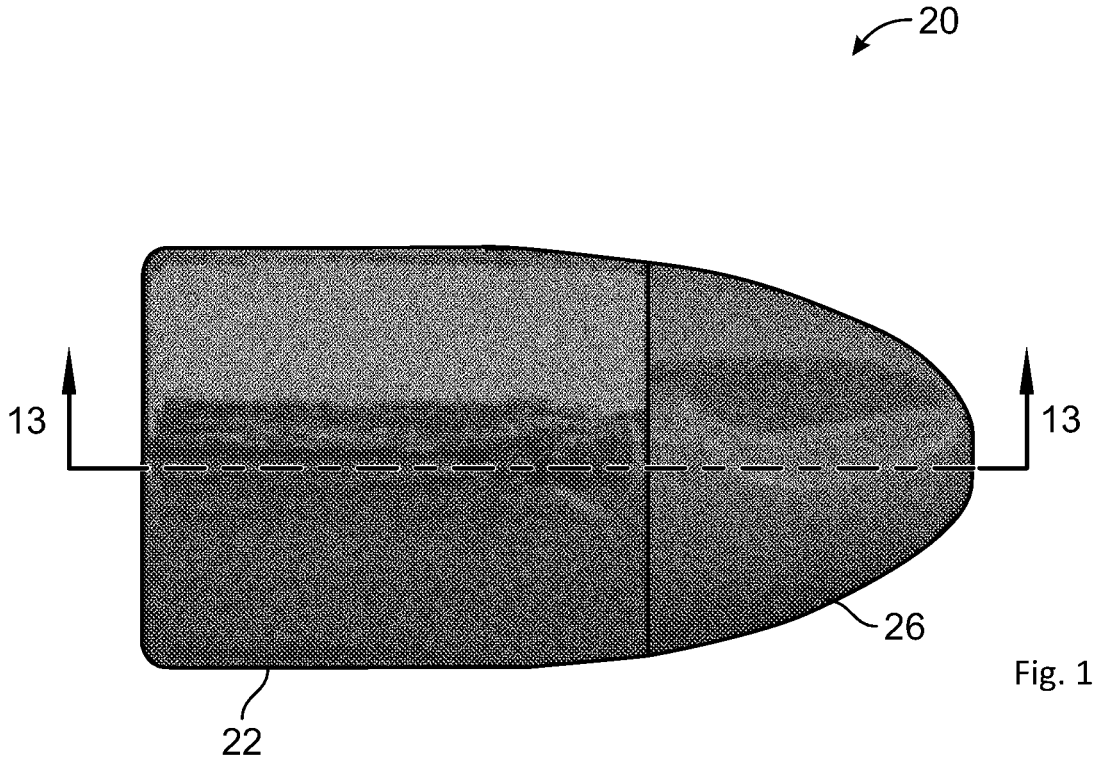
FIG. 12 is a side elevation view of the preferred embodiment of a bullet.
Figure 13:
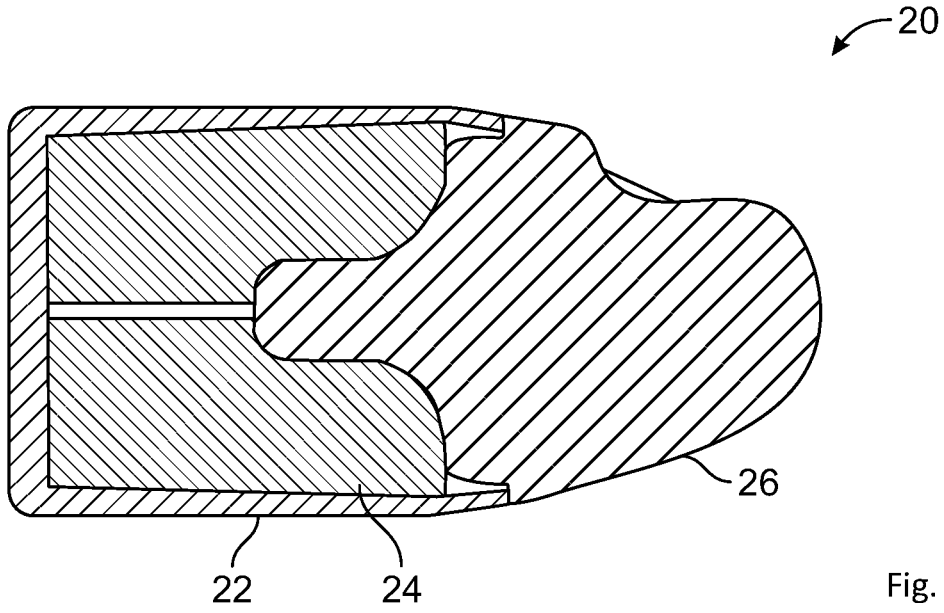
FIG. 13 is a longitudinal cross sectional view of the bullet shown in FIG. 12.

The core 24 is disposed inside the jacket 22, and has generally cylindrical shape corresponding to the shape of the interior of the jacket. The core 24 can be formed in the jacket 22, for example by injecting molten metal into the jacket, or by inserting a preformed cylindrical core element, and optionally pressing the core into jacket. The core 24 preferably has a axial passage 38 extending between the rear end and the front end of the core. The core 24 preferably also has a plurality of slits 40 formed therein. The slits 40 preferably extend radially outwardly from the central passage, toward the outer surface of the core 24. The slits 40 are preferably equally spaced around the circumference of the core 24. The slits 40 preferably do not extend all the way to the outer surface so that the slits divide the core into a plurality of segments joined by a web of material adjacent the outer surface. As shown in FIG. 8, in the preferred embodiment there are four slits 40, dividing the core 24 into four connected segments. There could be fewer (e.g., 2 or 3) or more (e.g., 5 to 8) slits, but the inventors have found that dividing the core 24 into four segments provides a good balance between the number of segments and their size. The core 24 is preferably lead or a lead alloy. However, alternate core materials could be utilized if a projectile containing no lead was desired, for example zinc which can be cast into a fragmentable shape, or tin, copper, aluminum, or even a polymer or metal filled polymer.

The tip 26 has a forwardly facing ogival surface 42 tapering to a front end 44. In this preferred embodiment the front end 44 is relatively blunt, but the front end could be made to come to a sharper, if appropriate. The tip 26 also has a rearwardly facing surface 46 that smoothly tapers to a generally cylindrical shank 48 with a flat end 50 with rounded edges. The shank 48 is embedded in, and frictionally engaged by, the core 24. The tip 26 has a rearwardly facing shoulder 52 that abuts the front-facing front end 30 of the jacket 22 forming a smooth transition at the junction between the jacket 22 and tip 26.

In addition to, or instead of, the frictional engagement of the shank 48 of the tip 26 with the core 24, the tip can be engaged and secured by the tip 34 on the front end of the jacket 22. There are a plurality of notches 54 formed in the forwardly facing ogival surface 42 of the tip 26. Each of the notches 54 has a forward end 56 adjacent the forward end of the tip 26, and a rear end 56 rearward of the rearwardly facing shoulder 52 and the front end 30 of the jacket 22. The notches 54 provide passageways for fluids and other materials from the target to enter into the jacket and expand the jacket to release the segments of the core. The configuration of the rearwardly facing surface 46 also acts as wedge to open the jacket 22 and separate the segments of the core 24. The notches 54 in the tip 26 are preferably equally spaced around the circumference of the tip, and there are preferably three notches. There could be fewer (e.g., two) or more (e.g., four to six) notches 54. The tip 26 is preferably made of a polymer filled with a metal powder, such as copper powder, as disclosed in U.S. Pat. No. 9,841,260, incorporated herein by reference. The tip could be of some other material including metals, or suitably hard and tough polymers.

The bullet of the preferred embodiment is of simple construction. The notches 54 in the tip 26 channel material into the interior of the jacket 22, facilitating the opening of the scored jacket 22, and the fragmentation of the core 24.

Manufacture

Figures 14A, 14B, 14C, 14D, 14E, 14F:
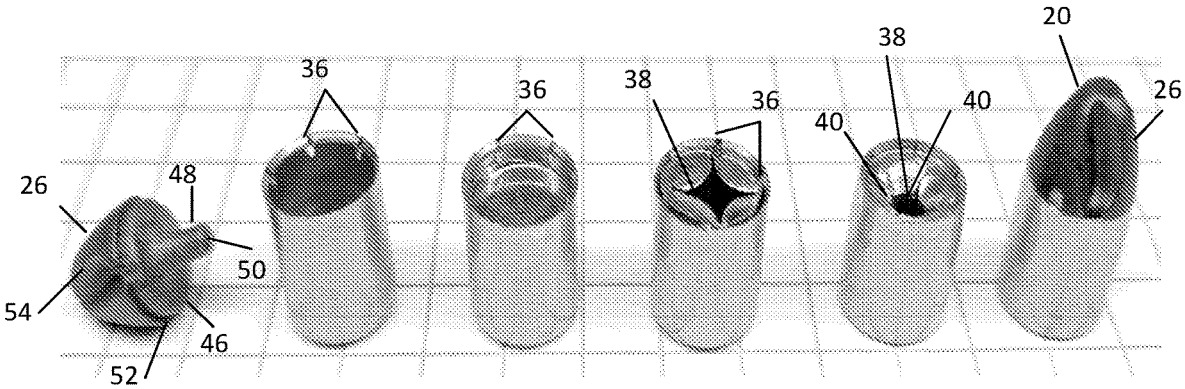
FIGS. 14A-14F are photographs illustrating the several stages of manufacture of the preferred embodiment of a bullet.
Figures 15A, 15B, 15C, 15D:
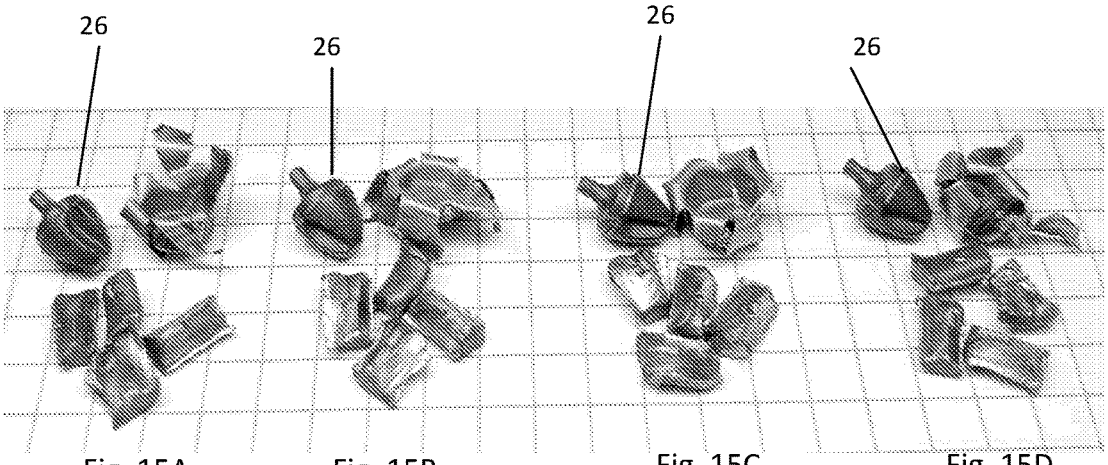
FIGS. 15A-15D show pieces of the preferred embodiments of bullets recovered after firing into ballistic gelatin.

A preferred method of manufacture is illustrated in FIGS. 14A-14F. As shown in FIG. 14A a tip 26 is premanufactured, such as by molding or casting as disclosed in U.S. Pat. No. 9,841,260. As shown in FIG. 14B, a jacket preform is also premanufactured, for example by a drawing operation as is known in the art. The jacket perform can already have scores in it as shown, or these can be added in a later step, such as when the core is seated or punched or shaped. As shown in FIG. 14C the core 24 is seated in the jacket preform. This can be accomplished by pouring molten metal into the jacket preform, or by inserting a core preform into the jacket and compressing it into the jacket preform with a press. As shown in FIG. 14D, the seated core 24 is punched to form the axial passage 38 and the slits 40. As shown in FIG. 14E, the core seated in the jacket preform can be further shaped to receive the tip 26 in a further punching operating and the lip formed on the front end 30 of the jacket. Finally as shown in FIG. 14F, the tip 26 is pressed into the preassembled jacket 22 and core 24, so that the shank 48 of the tip is frictionally engaged in the axial passage 38 in the core, and the front edge of the jacket abuts the rearwardly facing shoulder 52 on the tip to form a smooth continuous joint.

Operation

Figure 16:
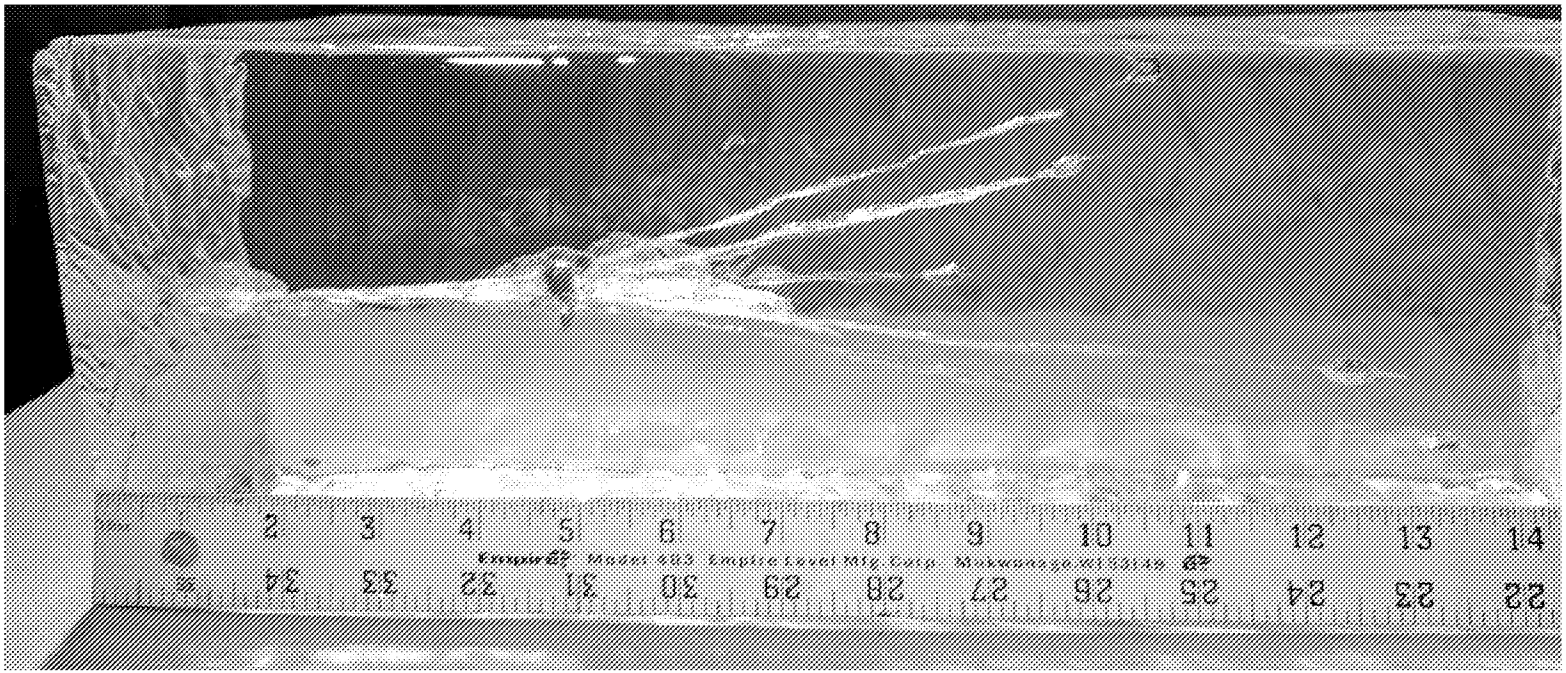
FIG. 16 is a side elevation view of a block of ballistic gelatin showing how a bullet of the preferred embodiment breaks upon striking target.

As shown in FIG. 16 when the bullet of the preferred embodiment is fired into a target, such as the ballistic gelatin shown in FIG. 17, the material from the target is channeled through the notches 54 into the jacket 22 of the bullet 20. This helps expand the jacket 22 which separates into petals, releasing the core 24. In addition, the impact with the target forces the tip 26 into the core 24. The configuration of the rearwardly facing surface 46 of the tip 26 wedges the core 28, which is segmented by the slits 40, into separate pieces. As shown in FIG. 17, the multiple pieces form multiple paths through the target, maximizing disruption of the target.

As shown in FIG. 15A-15D, the opened jacket, the tip, and the segments forming the core all separate during the penetration of the target. The design of the tip and the number and shape of the fluid channeling notches in the tip control the rate at which fragmentation of the projectile occurs.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A bullet comprising:

a jacket, the jacket being generally cup-shaped with a closed rear end, an open front end, a generally cylindrical sidewall between the rear end and the front end with an inwardly tapering lip adjacent the front end;

a core disposed inside the jacket, the core being generally cylindrical with an axial passage extending from the rear end to the front end, and having a plurality of slits therein extending from the axial passage partway toward the exterior of the core, dividing the core into a plurality of separable segments joined by a web of material adjacent their outer surfaces; and a tip, having a forwardly facing ogival surface tapering to a forward end, a rearwardly facing surface smoothly tapering to a generally cylindrical shank, the rearwardly facing surface conforming to the face of the core with the shank embedded in and frictionally engaging the core, and a rearwardly facing shoulder abutting the front end of the jacket forming a smooth transition therewith, and a plurality of notches formed in the forwardly facing ogival surface; each notch having a forward end adjacent the forward end of the tip, and a rear end rearward of the rearwardly facing shoulder and the front end of the jacket.

2. The bullet according to claim 1 where there are three notches formed in the forwardly facing ogival surface.

3. The bullet according to claim 2 wherein the notches equally spaced around the circumference of the core tip.

4. The bullet according to claim 3 wherein there are a plurality of scores in the jacket adjacent the front end.

5. The bullet according to claim 4 wherein the scores in the jacket are equally spaced circumferentially around the jacket.

6. The bullet according to claim 5 there are six scores in the jacket adjacent the front end.

7. The bullet according to claim 6 wherein the thickness of the jacket tapers from the rear end to the front end.

8. The bullet according to claim 7 wherein the jacket is copper or a copper alloy.

9. The bullet according to claim 8 wherein the core is lead or a lead alloy.

10. The bullet according to claim 9 wherein the tip is a polymer filled with metal particles.

11. The bullet according to claim 1 wherein the notches equally spaced around the circumference of the tip.

12. The bullet according to claim 1 wherein there are four notches formed in the forwardly facing ogival surface.

13. The bullet according to claim 1 wherein there are a plurality of scores in the jacket adjacent the front end.

14. The bullet according to claim 13 wherein the scores in the jacket are equally spaced circumferentially around the jacket.

15. The bullet according to claim 14 there are six scores in the jacket adjacent the front end.

16. The bullet according to claim 1 wherein the thickness of the jacket tapers from the rear end to the front end.

17. The bullet according to claim 1 wherein the jacket is copper or a copper alloy.

18. The bullet according to claim 1 wherein the core is lead or a lead alloy.

19. The bullet according to claim 1 wherein the tip is a polymer filled with metal particles.

* * * * *